US005864734A

United States Patent [19]

Lewis et al.

[11] Patent Number: 5,864,734

[45] Date of Patent: Jan. 26, 1999

[54] DEVELOPMENT SYSTEM PRODUCING REDUCED AIRBORNE TONER CONTAMINATION

[75] Inventors: Richard B. Lewis, Williamson; William H. Wayman, Ontario, both of N.Y.

[73] Assignee: Xerox Corporation, Stamford, Conn.

[21] Appl. No.: 897,589

[22] Filed: Jul. 21, 1997

[51] Int. Cl.[6] ..... G03G 15/08; G03G 21/00

[52] U.S. Cl. ..... 399/99; 399/266; 399/291

[58] Field of Search ..... 399/98, 99, 264, 399/266, 290, 291

[56] References Cited

U.S. PATENT DOCUMENTS

| | | | |
|---|---|---|---|
| 5,289,240 | 2/1994 | Wayman | 399/266 |
| 5,311,258 | 5/1994 | Brewington et al. | 399/291 X |
| 5,360,940 | 11/1994 | Hays | 399/266 |
| 5,517,287 | 5/1996 | Rodriguez et al. | 399/291 X |
| 5,613,178 | 3/1997 | Amico | 399/266 |

FOREIGN PATENT DOCUMENTS

| | | |
|---|---|---|
| 58-87568 | 5/1983 | Japan . |
| 63-80280 | 4/1988 | Japan . |

*Primary Examiner*—Fred L Braun
*Attorney, Agent, or Firm*—Lloyd F. Dean, II

[57] ABSTRACT

An apparatus for powder cloud development of an electrostatic image in which a donor roll advances toner to a development zone adjacent the image, and in which precipitating electric fields are provided at the entrance and exit of the development zone to redeposit undeveloped toner onto the surface of the doner member, whereby unwanted airborne emissions of toner are substantially reduced.

10 Claims, 4 Drawing Sheets

DEVELOPMENT SYSTEM PRODUCING REDUCED AIRBORNE TONER CONTAMINATION

This invention relates generally to an electrophotographic printing machine and more particularly concerns an improved scavengeless development system producing reduced airborne toner contamination.

This application incorporates by reference U.S. Pat. No. 5,172,170 and U.S. Pat. No. 5,289,240.

Generally, the process of electrophotographic printing includes charging a photoconductive member to a substantially uniform potential to sensitize the photoconductive surface thereof. The charged portion of the photoconductive member is exposed to a light image of an original document being reproduced. This records an electrostatic latent image on the photoconductive member. After the electrostatic latent image is recorded on the photoconductive member, the latent image is developed by exposing it to a population of charged, pigmented toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of development system is a scavengeless development system that uses a donor roll for transporting charged toner to the development zone together with means for creating a cloud of toner within the development zone formed between the donor and the photoconductive member. One cloud forming means is disclosed in U.S. Pat. No. 4,868,600. That patent discloses a plurality of electrode wires closely spaced to the donor roll in the development zone. An AC voltage is applied to the wires forming a toner cloud in the development zone. The electrostatic fields generated by the latent image attract toner from the toner cloud to develop the latent image.

In a hybrid scavengeless development unit, a magnetic brush developer roller is employed for transporting carrier having toner particles adhering triboelectrically thereto. The donor roll and magnetic roll are electrically biased relative to one another. Toner is attracted to the donor roll from the magnetic roll. The electrically biased electrode wires detach the toner from the donor roll forming a toner powder cloud in the development zone. The latent image attracts the toner particles thereto from the toner powder cloud. In this way, the latent image recorded on the photoconductive member is developed with toner particles.

U.S. Pat. No. 5,172,170, assigned to the assignee of the present application, discloses a "scavengeless" development unit in which a set of longitudinally-disposed electrodes is embedded in the surface of a rotating donor roll. A wiping brush is used to energize or commutate those electrodes in the development zone. When the electrodes are energized, the toner near the electrodes jumps off the donor roll and forms a powder cloud which may be used to develop the latent image. In this development unit the electric fields which generate the cloud are generally those formed between the electrodes and a conductive core within the donor roll.

U.S. Pat. No. 5,289,240, assigned to the assignee of the present application, discloses a "scavengeless" development unit in which two sets of interdigitated, longitudinally-disposed electrodes are embedded in the surface of a rotating donor roll. One set is connected in common to a slip ring, and a wiping brush is used to energize or commutate the other set in the development zone. When the electrodes are energized, the toner near the electrodes jumps off the donor roll and forms a powder cloud which may be used to develop the latent image. In this development unit the electric fields which generate the cloud are generally those formed between electrodes of each set.

In one type of scavengeless development unit, a layer of toned carrier is carried through the development zone on a donor roll or donor member, kept out of contact with the latent image bearing member, and a toner cloud generated directly from the surfaces of toned carrier. In these systems clouding action may be due to mechanical agitation within the developer mass or to the application of strong electric fields to the developer mass. A problem, which has not been generally realized, is that, in scavengless development systems which generate powder clouds, more toner must be clouded within the development zone than will usually be developed onto image areas, so that the undeveloped excess is a source of airborne dirt, being carried out of the development zone on air currents caused by donor and photoconductive element motion. It is an object of the present invention to substantially reduce such airborne dirt by providing means to recapture undeveloped toner on the donor surface.

In accordance with one aspect of the present invention, there is provided an apparatus in which a donor roll advances toner to an electrostatic latent image recorded on a photoconductive member. A plurality of electrical conductors is located on the donor roll. The electrical conductors are spaced from one another and adapted to be electrically biased in the development zone to detach toner from the donor roll to form a toner cloud in the development zone. In the development zone, toner is attracted from the toner cloud to the latent image. The electrical conductors are further adapted to be electrically biased at the entrance and exit of the development zone to force airborne toner back to the roll. A commutator contacts the electrodes along a portion of the circumference of the donor roll adjacent the development zone, the commutator includes a brush having fibers in contact with portions of a subset of the electrodes, wherein a first, central portion of the brush is AC biased to generate a toner cloud for developing said latent image and two surrounding second portions of the brush are DC biased to force undeveloped toner back onto the roll. Provision is made to prevent the brush portions shorting to each other.

Other features of the present invention will become apparent as the following description precedes and upon reference to the drawings, in which.

Inasmuch as the art of electrophotographic printing is well known, the various processing stations employed in the FIG. 4 printing machine will be shown hereinafter schematically and their operation described briefly with reference thereto.

Figure 4:
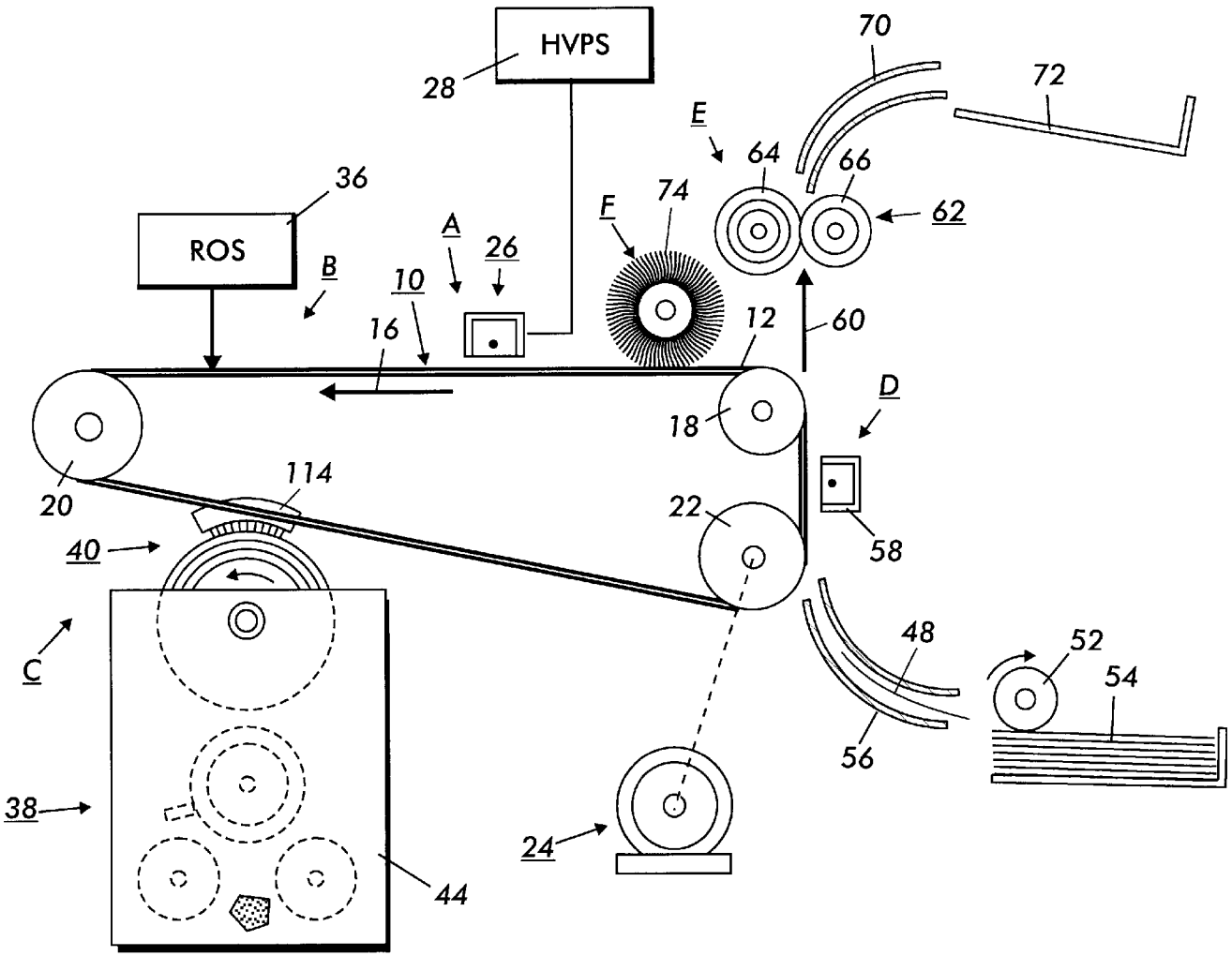
FIG. 4 is a schematic elevational view of an illustrative electrophotographic printing machine incorporating the FIG. 2 development apparatus therein.

Referring initially to FIG. 4, there is shown an illustrative electrophotographic printing machine incorporating the development apparatus of the present invention therein. The electrophotographic printing machine employs a belt 10 having a photoconductive surface 12 deposited on an electrically grounded conductive substrate 14. One skilled in the art will appreciate that any suitable photoconductive material may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a suitable pair of springs (not shown) resiliently urging tensioning roller 20 against belt 10 with the desired spring force. Stripping finger 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, a raster output scanner 36 layouts an image in a series of horizontal scan lines with each line having a specified number of pixels per inch onto the charged portion of photoconductive surface 12 to selectively dissipate the charge thereon. This records an electrostatic latent image on photoconductive surface 12. Typically, a raster output scanner includes a laser with a rotating polygon mirror block and a modulator.

After the electrostatic latent image has been recorded on photoconductive surface 12, belt 10 advances the latent image to development station C. At development station C, a developer unit, indicated generally by the reference numeral 38 develops the latent image recorded on the photoconductive surface. Preferably, developer unit 38 includes a donor roller 40 having a plurality of electrodes or electrical conductors 42 embedded therein and integral therewith. The electrical conductors are substantially equally spaced and located closely adjacent to the circumferential surface of donor roll 40. Electrical conductors 42 are electrically biased in the development zone to detach toner from donor roll 40. In this way, a toner powder cloud is formed in the gap between donor roll 40 and photoconductive surface 12. The latent image recorded on photoconductive surface 12 attracts toner particles from the toner powder cloud forming a toner powder image thereon. Donor roller 40 is mounted, at least partially, in the chamber of developer housing 44. The chamber in developer housing 44 stores a supply of developer material. The developer material is a two-component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller at a loading zone. Developer unit 38 will be discussed hereinafter, in greater detail, with reference to FIG. 1.

With continued reference to FIG. 4, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 1:
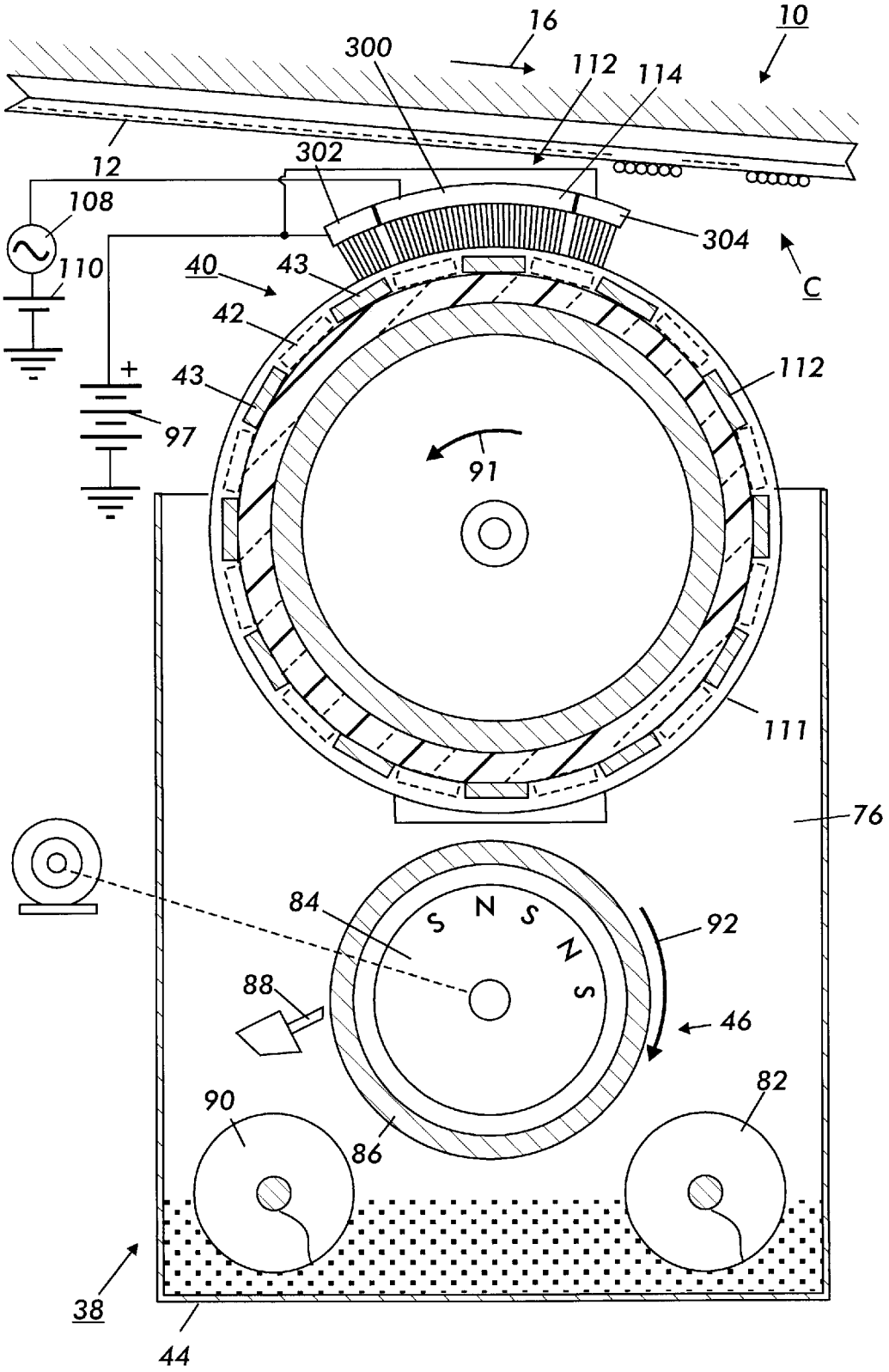
FIG. 1 is a schematic elevational view showing the development apparatus according to one embodiment of the invention.

Referring now to FIG. 1, there is shown developer unit 38 in greater detail. As shown thereat, developer unit 38 includes a housing 44 defining a chamber 76 for storing a supply of developer material therein. In the preferred embodiment donor roll 40 has two interdigitated sets 42 and 43 of electrical conductors positioned in grooves about the peripheral circumferential surface thereof. The electrical conductors are substantially equally spaced from one another and insulated from each other. The electrodes of set 42 are connected commonly to a grounded slip ring not shown and the electrodes of set 43 are exposed at the end of the roll to the commutation brush 114. Donor roll 40 rotates in the direction of arrow 91. A magnetic roller 46 is also mounted in chamber 76 of developer housing 44. Magnetic roller 46 is shown rotating in the direction of arrow 92. Magnetic roller 46 and portions of donor roll 40 may be electrically biased relative to each other by AC and/or DC as required, by means not shown, in order to effect loading of toner from the magnetic roll 46 to the surface of the donor roll 40. As a particular electrode of the set 43 approaches the development zone it comes into wiping contact with section 304 of brush 114 and is thereby brought to the potential set by DC supply 97. This potential is selected to develop any airborne toner back onto the donor roll in the exit region of developer unit 38 preferably the potential is between 100 and 1000 volts DC. Next the particular electrode moves into the development zone where it comes into wiping contact with section 300 of brush 114 and is thereby connected to a DC voltage having an AC voltage superimposed thereon. In this way, an AC voltage difference is applied between the particular electrode 43 and the adjacent, grounded electrodes of the set 42 detaching toner from the donor roll and forming a toner powder cloud. Voltage 110 can be set at an optimum bias that will depend upon the toner charge, but typically the bias range is between 100 and 1000 volts DC. Next the particular electrode moves into wiping contact with section 302 of brush 114 and is thereby brought to the potential set by DC supply 97. This potential is selected to develop any airborne toner back onto the donor roll in the entrance region of developer unit 38. In this example the polarity of DC supply 97 is suitable for negatively charged toner. Finally the particular electrode moves away from the development zone and its potential relaxes toward that of the neighboring common electrodes, generally the same voltage as source 110 with respect to ground Magnetic roller 46 advances a constant quantity of toner having a substantially constant charge onto donor roll 40. This ensures that donor roller 40 provides a constant amount of toner having a substantially constant charge in the development zone. Metering blade 88 is positioned closely adjacent to magnetic roller 46 to maintain the compressed pile height of the developer material on magnetic roller 46 at the desired level. Magnetic roller 46 includes a non-magnetic tubular member 86 made preferably from aluminum and having the exterior circumferential surface thereof roughened. An elongated magnet 84 is positioned interiorly of and spaced from the tubular member. The magnet is mounted stationary. The tubular member rotates in the direction of arrow 92 to advance the developer material adhering thereto into a loading zone. In loading zone, toner particles are attracted from the carrier granules on the magnetic roller to the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

Figure 2:
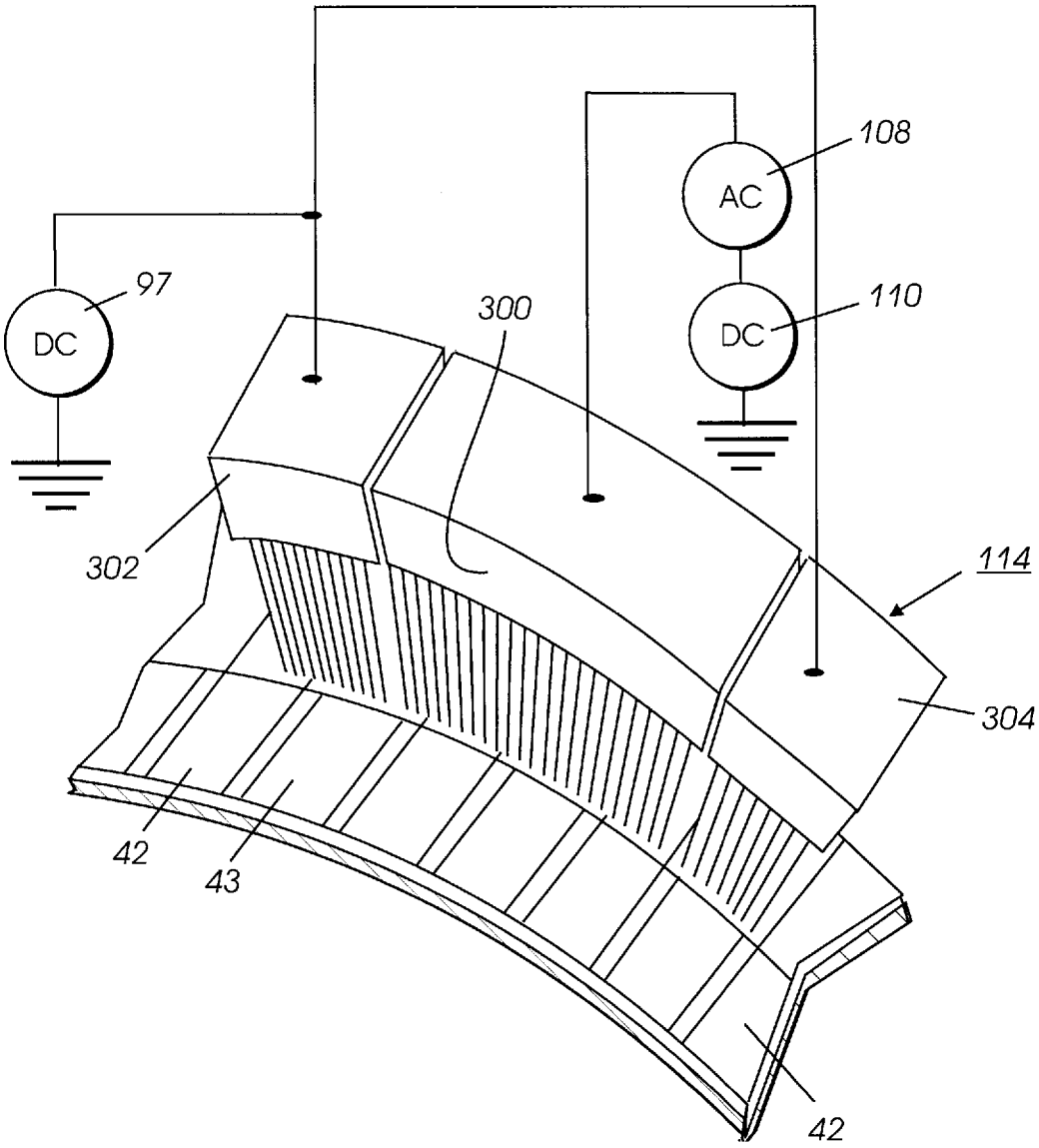
FIG. 2 is an elevational view of a wiping brush according to another embodiment of the invention.

Turning to FIG. 2 wiping brush 114 in greater detail, brush 114 is disposed at one end of the donor roll 40, preferably at a location spaced away from the length of the donor roll 40 corresponding to the imaging area on belt 10. It will be seen in FIG. 2 that the filaments of brush 114 contact electrodes 43 at one end of the donor roll 40; of course, contact by the filaments at this one point will energize the contacted electrodes 43 for the entire length thereof. It can be seen that the brush 114 includes a plurality of filaments which contact a section of the circumference of a donor roll 40, so that the electrode wires 43 in development zone adjacent the surface 12 of belt 10 may be energized as desired by voltage sources 97 and 110, or by voltage source 108, depending on the position of electrode wire. AC source 108 and DC source 110 are connected to brush portion 300 and thus act to energize only those electrodes 43 in the development zone. This AC and DC biasing of the electrodes 43 cause toner loaded on the surface of donor roll 40 to jump off the surface of the donor roll 40 and form a powder cloud so that some of the toner in the powder cloud will adhere to the surface 12 of belt 10, thereby developing the electrostatic latent image thereon. Brush portions 302 and 304 are positioned over the entrance and exit regions of the development nip and connected to a DC source 97. As a particular electrode 43 moves into brush 300 and as it moves between brush portions of brush 300 its potential is changed. It is advantageous to make such potential changes smoothly and gradually to avoid short circuits between brush portions, and to avoid destructive arcing caused by the sudden large currents necessary to change potential rapidly. Smooth and gradual potential changes are preferably brought about by the methods taught in U.S. Pat. No. 5,289,240, namely by making the brush fibers partially resistive and by providing in each brush portion central regions of relatively lower resistivity surrounded by regions of relatively higher resistivity.

Figure 3A:
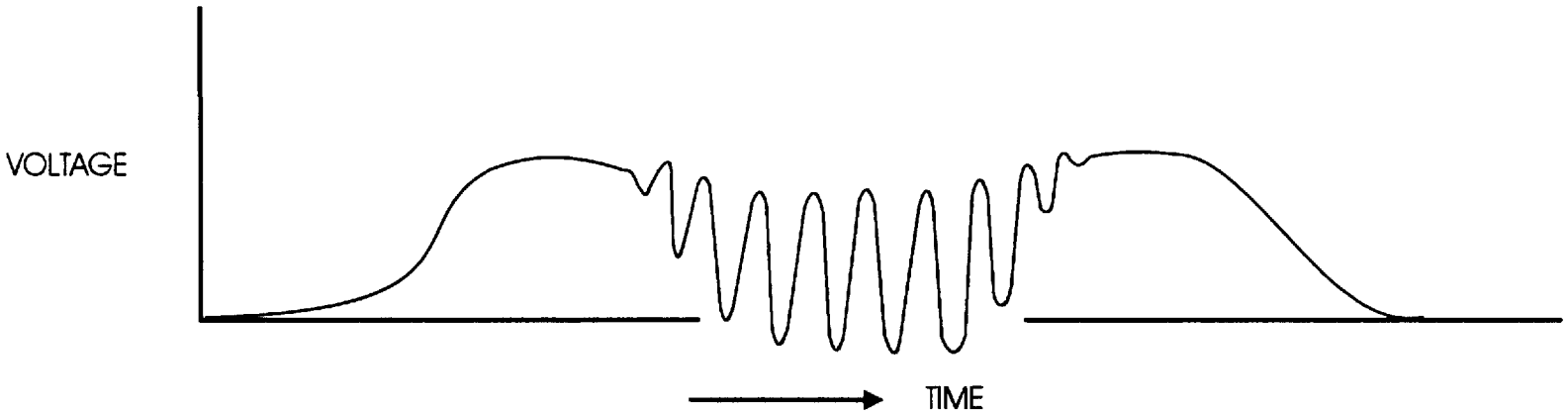
FIG. 3A PRIOR ART
FIG. 3A is a prior art graph of the voltage relative to the ground plane of the photoconductive member of a single energized electrode as the electrode approaches, traverses, and leaves the development zone.
Figure 3B:
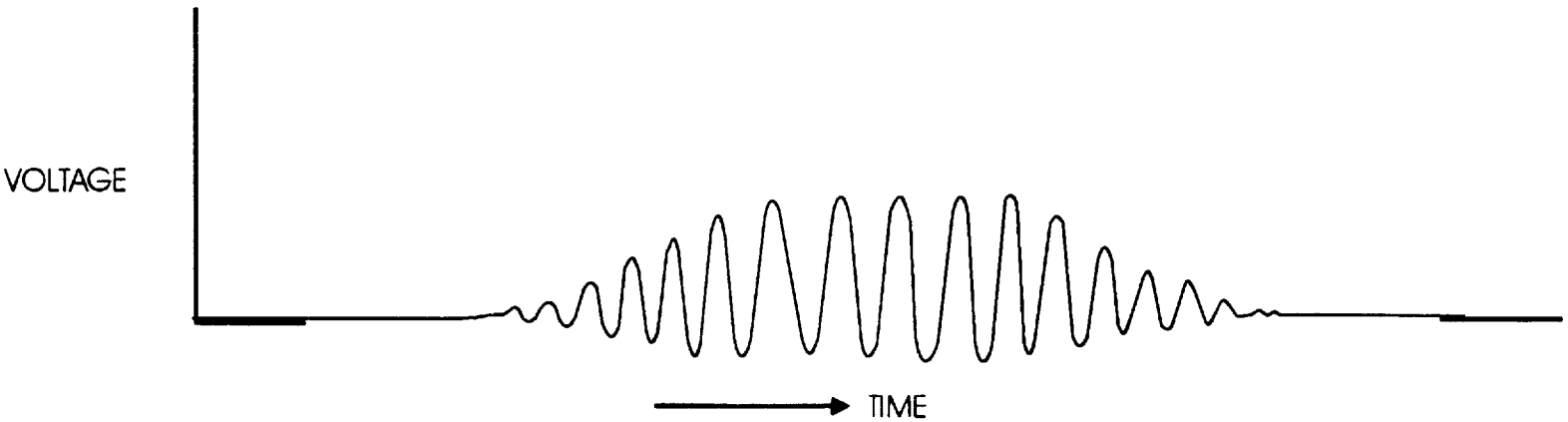
FIG. 3B is a graph of the voltage relative to the ground plane of the photoconductive member of a single energized electrode as the electrode approaches, traverses, and leave he development zone according to an embodiment of the present invention.

Referring to FIG. 3A and 3B, FIG. 3A is a schematic prior art graph of the voltage relative to the ground plane of the photoconductive member of a single energized electrode as the electrode approaches, traverses, and leaves the development zone. FIG. 3B is a graph of the voltage relative to the ground plane of the photoconductive member of a single energized electrode as the electrode approaches, traverses, and leaves the development zone according to the present invention. Accordingly FIG. 3B traces the electric fields created at the entrance and exit of the development zone and shows the dirt controlling fields provided by the invention. It is drawn for the case of negatively charged toner, and the strong positive biases at the entrance and exit of the development zone mean that such toner will be drawn toward and deposited upon the donor in these regions. In the case that a subset of electrodes is held at fixed potential, dirt controlling electric fields are still created which are due to the average potential of all the electrodes. In FIG. 3A there are no dirt-controlling fields.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for developing an electrostatic image recorded on an image-bearing surface, comprising:

a housing defining a chamber storing at least a supply of toner therein;

a donor member spaced from said image-bearing surface and adapted to transport toner from said housing to said image-bearing surface, said donor member having a development zone wherein toner is transported to the electrostatic image, said donor member having an entrance region immediately before said development zone and an exit region immediately after said development zone;

cloud generating means for generating a toner cloud within said development zone; said entrance and exit regions having electrode means for generating precipitating electric fields at the entrance and exit regions of said donor member, said precipitating electric fields directed to attract airborne toner in said entrance and exit regions to be deposited onto the surface of said donor member, whereby unwanted airborne emissions of toner are substantially reduced.

2. The apparatus according to claim 1 wherein said donor member comprises:

a plurality of electrodes each disposed transverse to the process direction and parallel to said surface of said doner member.

3. The apparatus according to claim 2, further comprising commutation means for commutating a first electrical potential to a first subset of said plurality of electrodes, and a second electrical potential to a second subset of said plurality of electrodes.

4. The apparatus according to claim 3, wherein said cloud generating means comprises said first electrical potential including an alternating electric field.

5. The apparatus according to claim 3, wherein said commutation means comprises a brush having semiconducting fibers, having a center section thereof is biased to said first potential and an end sections thereof is biased to said second potential.

6. An apparatus for developing a latent image recorded on a surface, including:

a housing defining a chamber storing at least a supply of toner therein;

a donor member spaced from the surface and adapted to transport toner from the chamber of the housing to a development zone adjacent the surface;

a plurality of electrodes longitudinally disposed on the donor member; and a commutator contacting the electrodes along a portion of the circumference of the donor member, the commutator is in contact with a first set of said plurality of electrodes located in said development zone and is biased to generate a toner cloud for developing said latent image and the commutator is in contact with a second set of said plurality of electrodes, adjacent to said first set of said plurality of electrodes and is biased to attract undeveloped toner back onto the donor member.

7. The apparatus according to claim 6, wherein said commutator includes a brush having a first portion of fibers in contact with said first set of said plurality of electrodes and second portion of fibers in contact with said second set of said plurality of electrodes.

8. The apparatus according to claim 7, wherein said first portion of fibers in contact with said first set of said plurality of electrodes defining the development zone, and wherein said first set of said plurality of electrodes in contact with said first portion of the brush is AC biased to provide AC fields to generate a toner cloud.

9. The apparatus according to claim 7, wherein said second portion of fibers in contact with said second set of said plurality of electrodes defining an entrance and an exit of the development zone and wherein said second set of said plurality of electrodes in contact with said second portion of the brush produces substantially stationary DC electric fields directed at the entrance and exit of the development zone to deposit toner onto the donor member surface.

10. The apparatus as in claim 7, wherein the first portion of the brush includes a first region having fibers of a first predetermined resistance and a second region having fibers of a second predetermined resistance.

* * * * *